US008864276B2

(12) United States Patent
Yamato et al.

(10) Patent No.: US 8,864,276 B2
(45) Date of Patent: Oct. 21, 2014

(54) PRINTHEAD AND PRINTING APPARATUS UTILIZING DATA SIGNAL TRANSFER ERROR DETECTION

(75) Inventors: Hidenori Yamato, Tokyo (JP); Tatsuo Furukawa, Zama (JP); Nobuyuki Hirayama, Fujisawa (JP); Ryo Kasai, Tokyo (JP); Kimiyuki Hayasaki, Kawasaki (JP); Shinji Takagi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 12/963,661

(22) Filed: Dec. 9, 2010

(65) Prior Publication Data

US 2011/0273507 A1 Nov. 10, 2011

(30) Foreign Application Priority Data

May 10, 2010 (JP) ..... 2010-108676

(51) Int. Cl.
*B41J 29/393* (2006.01)
*B41J 2/045* (2006.01)

(52) U.S. Cl.
CPC ..... *B41J 2/04508* (2013.01); *B47J 2/04541* (2013.01); *B41J 2/0458* (2013.01); *B41J 2202/20* (2013.01); *B41J 2/04543* (2013.01); *B41J 2/0451* (2013.01)
USPC ..... 347/19

(58) Field of Classification Search
None
See application file for complete search history.

(56) References Cited

U.S. PATENT DOCUMENTS

| | | | | |
|---|---|---|---|---|
| 5,172,134 | A | 12/1992 | Kishida et al. | |
| 5,239,318 | A * | 8/1993 | Vannerson | 347/128 |
| 5,519,416 | A * | 5/1996 | Hayasaki et al. | 347/13 |
| 5,731,828 | A | 3/1998 | Ishinaga et al. | |
| 6,054,689 | A | 4/2000 | Imanaka et al. | |
| 6,116,714 | A | 9/2000 | Imanaka et al. | |
| 6,302,504 | B1 | 10/2001 | Imanaka et al. | |
| 6,523,922 | B2 | 2/2003 | Hirayama | |
| 7,101,099 | B1 * | 9/2006 | Furukawa et al. | 400/120.01 |
| 7,133,153 | B2 | 11/2006 | Furukawa | |
| 7,321,444 | B2 | 1/2008 | Hirayama | |
| 7,354,125 | B2 | 4/2008 | Hirayama et al. | |
| 7,530,653 | B2 | 5/2009 | Hirayama | |
| 7,896,474 | B2 | 3/2011 | Kasai et al. | |

FOREIGN PATENT DOCUMENTS

| | | | |
|---|---|---|---|
| JP | 10-324045 | A | 12/1998 |
| JP | 2002-067290 | A | 3/2002 |

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

This invention is directed to real time detection of occurrence of a transfer error and feedback of the detection result to a printing apparatus in consideration of a possible risk that a signal transfer error occurs on a transfer path that becomes longer as the printhead is elongated. To accomplish this, in a printhead configured by cascade-connecting a plurality of element substrates, information of a transfer error detected in real time in each element substrate during transfer of a print data signal is output to an element substrate on the next stage by taking account of information input from an element substrate on the preceding stage. Information containing pieces of information from all element substrates is output from an element substrate on the final stage.

18 Claims, 15 Drawing Sheets

PRINTHEAD AND PRINTING APPARATUS UTILIZING DATA SIGNAL TRANSFER ERROR DETECTION

BACKGROUND OF THE INVENTION

1. Field of the Invention

The present invention relates to a printhead and printing apparatus. Particularly, the present invention relates to a printhead configured by integrating, on the same substrate, a plurality of printing elements and a driving circuit for driving them, and a printing apparatus using the printhead.

2. Description of the Related Art

An inkjet printing apparatus is configured to print information on a printing medium by discharging ink from a plurality of small nozzles of a printhead in accordance with a print signal. The inkjet printing apparatus is advantageous because it can perform non-contact printing on a printing medium such as paper, easily prints in color, and is quiet.

In the printhead of the inkjet printing apparatus, a printing element (heater) is arranged at a portion communicating with an orifice for discharging an ink droplet. A current is supplied to the printing element to generate heat and heat ink. The film boiling resulting from the heating of ink causes an ink droplet to be discharged for printing. To drive the printhead, it is a common practice to divide an array of orifices into groups each of a plurality of orifices, and time-divisionally drive printing elements for each of the different blocks. In the printhead, many orifices and printing elements (heaters) can be easily arranged at high density, allowing a high-resolution printed image to be obtained.

Recent printheads need to implement color printing, have a large printing width, and print quickly. To meet these requirements, it is becoming popular for a printing apparatus to be equipped with a plurality of printheads with each printhead having a plurality of element substrates. Information about ink discharge driving conditions is transmitted as serial data or parallel data from the printing apparatus main body to each printing element substrate.

In this arrangement, if the number of element substrates or printheads increases, the numbers of wiring lines, connectors, and transfer paths for the element substrates or printheads also increase. As a result, the element substrate dimensions increase, the production cost rises, and the electrical reliability drops. An increasing number of signals transferred to the printhead and a longer transfer path may generate a print signal transfer error. Especially if a transfer error occurs in an image data signal or heat enable signal, printing may not be performed at an intended position or a heat enable signal having a pulse width different from a desired one may be generated, degrading the quality of a printed image. To prevent an increase in the number of signal lines and a complicated connection, a technique of cascade-connecting n element substrates, wiring lines between them, and the like has been developed (see Japanese Patent Laid-Open No. 2002-67290).

In Japanese Patent Laid-Open No. 2002-67290, the element characteristic output terminal and temperature sensor output terminal of each element substrate are cascade-connected to the element characteristic input terminal and temperature sensor input terminal of an adjacent element substrate, respectively. This allows serially reading out information data from all element substrates via the same signal path, which have been conventionally read out from the respective element substrates via different signal paths. With a smaller number of signal lines, data of the element characteristic and temperature of the element substrate, and information of a signal transfer error can be transmitted to the printing apparatus main body.

Japanese Patent Laid-Open No. 10-324045 discloses an arrangement in which a transfer error is detected by comparing image data signals on the control unit side of a printing apparatus and the printhead side. In Japanese Patent Laid-Open No. 10-324045, print data transferred from a head driving circuit is transferred to a shift register in the control unit of the printing apparatus and that in the printhead. The comparator of the printing apparatus compares the print data transferred to these shift registers, determining whether a transfer error has occurred. The transfer error determination result is fed back to the printing apparatus main body.

As described above, when the printing apparatus adopts an arrangement using a plurality of printheads or a plurality of element substrates, an increasing number of signal lines may raise the cost, and a signal transfer error may occur due to a long transfer path. It is, therefore, required to perform appropriate printing control by feeding back information about ink discharge driving conditions in real time to the printing apparatus main body while suppressing an increase in the number of wiring lines of the printhead.

In the technique disclosed in Japanese Patent Laid-Open No. 2002-67290, the number of wiring lines is decreased by cascade-connecting element substrates. However, as the number of element substrates increases, the amount of serially readout information also increases because pieces of information are serially read out from all element substrates. A long time is taken to read out all pieces of information, greatly delaying the printing operation. Thus, even if a signal transfer error is detected, it is difficult to output the information in real time and perform appropriate control.

In the technique disclosed in Japanese Patent Laid-Open No. 10-324045, the signal transfer error of each element substrate or printhead can be detected. However, when the number of element substrates or printheads increases, the number of wiring lines and the circuit scale increase.

SUMMARY OF THE INVENTION

Accordingly, the present invention is conceived as a response to the above-described disadvantages of the conventional art.

For example, a printhead and printing apparatus according to this invention are capable of detecting a print data transfer error in real time using a simple arrangement, and executing printing control based on the detection result.

According to one aspect of the present invention, there is provided a printhead comprising a plurality of element substrates, each having a plurality of printing elements and a driving circuit for driving the plurality of printing elements, the plurality of element substrates being cascade-connected, and each of the plurality of element substrates comprising: an error detection circuit configured to detect whether or not a transfer error has occurred in a print data signal corresponding to printing elements of one element substrate every time the print data signal corresponding to the printing elements of one element substrate is transferred and latched; and an error output circuit configured to output a result of detection by the error detection circuit to outside, wherein the error output circuit on each stage receives a detection result from the error output circuit on a preceding stage, in a case where the detection result from the error output circuit on the preceding stage indicates that a transfer error has occurred, outputs the detection result indicating that the transfer error has occurred, to the error output circuit on a next stage or outside of the printhead regardless of a detection result of the error detection circuit of the element substrate on the each stage, and in a case where the detection result from the error output circuit on the preceding stage indicates that no transfer error has occurred, outputs the detection result of the error detection circuit of the element substrate on the each stage to the error output circuit on the next stage or the outside of the printhead.

According to another aspect of the present invention, there is provided a printhead comprising a plurality of element substrates, each having a plurality of printing elements and a driving circuit for time-divisionally driving the plurality of printing elements for each block, the plurality of element substrates being cascade-connected, and each of the plurality of element substrates comprising: an error detection circuit configured to detect whether or not a transfer error has occurred in a print data signal corresponding to printing elements of one block every time the print data signal corresponding to the printing elements of one block is transferred and latched; and an error output circuit configured to output a result of detection by the error detection circuit to outside, wherein the error output circuit on each stage receives a detection result from the error output circuit on a preceding stage, in a case where the detection result from the error output circuit on the preceding stage indicates that a transfer error has occurred, outputs the detection result indicating that the transfer error has occurred, to the error output circuit on a next stage or outside of the printhead regardless of a detection result of the error detection circuit of the element substrate on the each stage, and in a case where the detection result from the error output circuit on the preceding stage indicates that no transfer error has occurred, outputs the detection result of the error detection circuit of the element substrate on the each stage to the error output circuit on the next stage or the outside of the printhead.

According to still another aspect of the present invention, there is provided an printing apparatus which prints using the above-described printhead, the apparatus comprising: a reception unit configured to receive presence/absence of a transfer error from the printhead; and a control unit which controls to continue transfer or retransmission of a print data signal in accordance with the presence/absence of the transfer error received by the reception unit.

The invention is particularly advantageous since the final result reflecting the transfer error detection results of respective element substrates can be output in a smaller amount of information without increasing the number of wiring lines between the element substrates which form a printhead. This information can be read out within a short period of time, and the circuit scale, the number of wiring lines, and the like do not increase.

Moreover, the printing apparatus executes printing control by feeding back information about a transfer error obtained from the printhead, improving the reliability of the printing operation.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings. Note that the relative arrangement of building components and the like set forth in these embodiments do not limit the scope of the present invention, unless otherwise specified.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "printing element" generally means a set of a discharge orifice, a liquid channel connected to the orifice and an element to generate energy utilized for ink discharge.

An inkjet printhead (to be referred to as a printhead), which is the most important feature of the present invention, is configured by integrating, on the same element substrate of the printhead, a plurality of printing elements and a driving circuit for driving them. As will be apparent from the following description, the printhead incorporates a plurality of element substrates, and these element substrates are cascade-connected. The printhead can therefore achieve a relatively large printing width. This printhead is employed not only in a general serial printing apparatus but also in a printing apparatus having a full-line printhead whose printing width corresponds to the printing medium width. This printhead is applied to a large-format printer using printing media of large sizes such as A0 and B0 among serial printing apparatuses.

A printing apparatus using the printhead of the present invention will be described first.

<Printing Apparatus with Full-Line Printhead (FIG. 1)>

Figure 1:
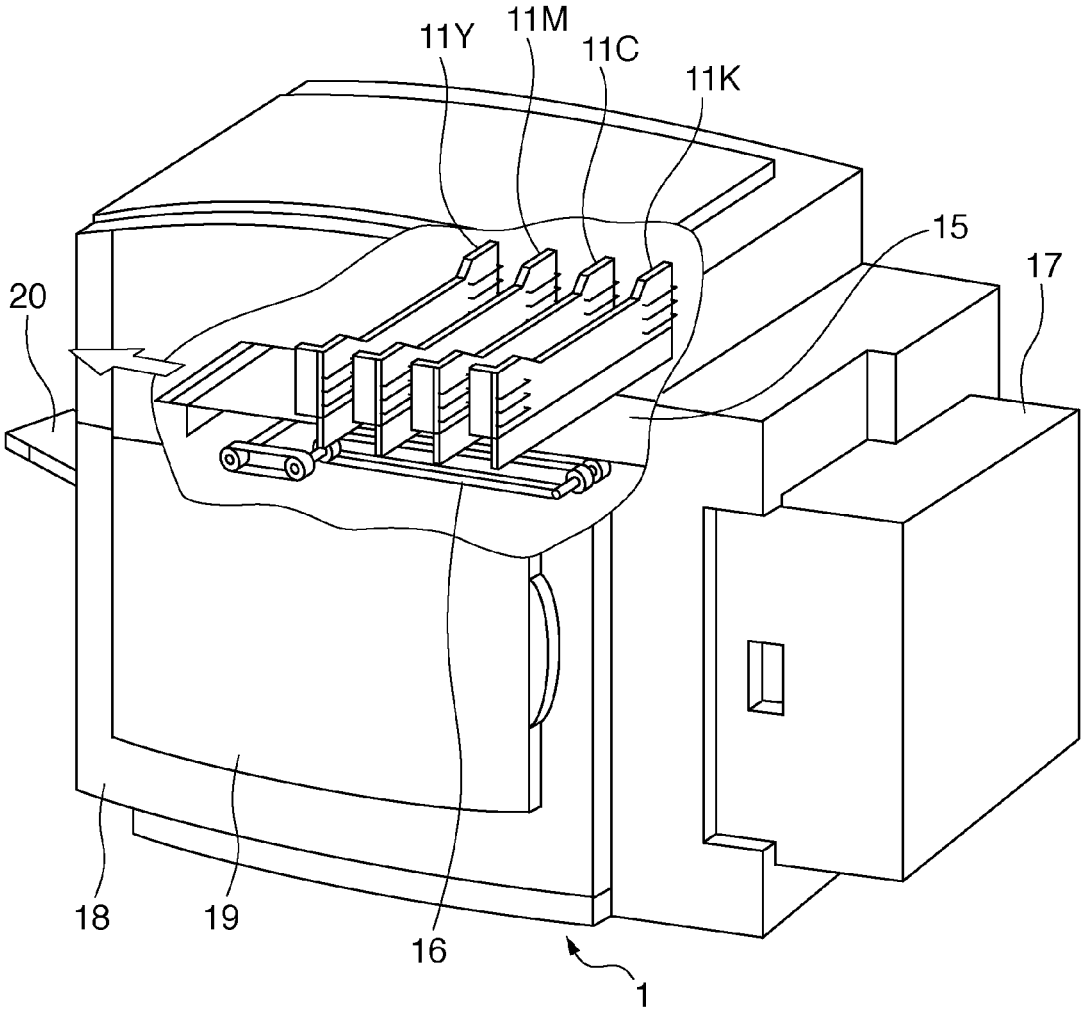
FIG. 1 is a perspective view for explaining the structure of a printing apparatus having a full-line printhead as an exemplary embodiment of the present invention.

FIG. 1 is a perspective view for explaining the structure of a printing apparatus 1 having full-line printheads 11K, 11C, 11M, and 11Y, and a recovery unit for always guaranteeing stable ink discharge.

In the printing apparatus 1, a printing sheet 15 is fed from a feeder unit 17 to the printing positions of the printheads, and conveyed by a conveyance unit 16 arranged in a housing 18 of the printing apparatus.

In printing an image on the printing sheet 15, the printing sheet 15 is conveyed. When the reference position of the printing sheet 15 reaches a position below the printhead 11K for discharging black (K) ink, the printhead 11K discharges black ink. Similarly, when the printing sheet 15 sequentially reaches the reference position of the printhead 11C for discharging cyan (C) ink, that of the printhead 11M for discharging magenta (M) ink, and that of the printhead 11Y for discharging yellow (Y) ink, the printheads 11C, 11M, and 11Y discharge the respective color inks, forming a color image. The printing sheet 15 bearing the image is discharged to a stacker tray 20 and stacked.

The printing apparatus 1 further includes the conveyance unit 16, and ink cartridges (not shown) exchangeable for the respective inks to supply inks to the printheads 11K, 11C, 11M, and 11Y. The printing apparatus 1 also includes pump units (not shown) for ink supply and recovery operations for the printheads 11K, 11C, 11M, and 11Y, and a control board (not shown) for controlling the overall printing apparatus 1. A front door 19 is an opening/closing door for exchanging the ink cartridge.

<Printing Apparatus Using Large-Size Printing Medium (FIGS. 2A and 2B)>

Figure 2A:
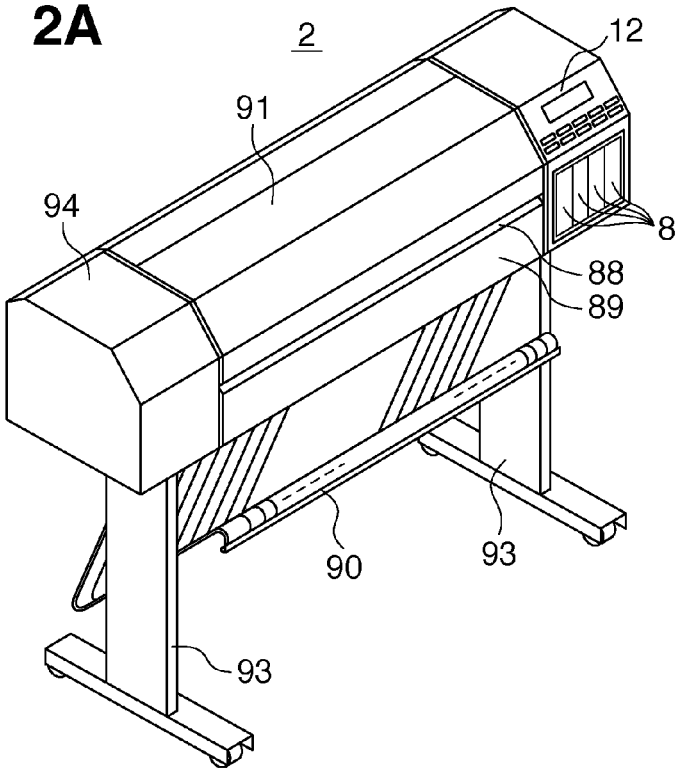
FIGS. 2A and 2B are perspective views showing the outer appearance of a printing apparatus using A0- and B0-size printing media.
Figure 2B:
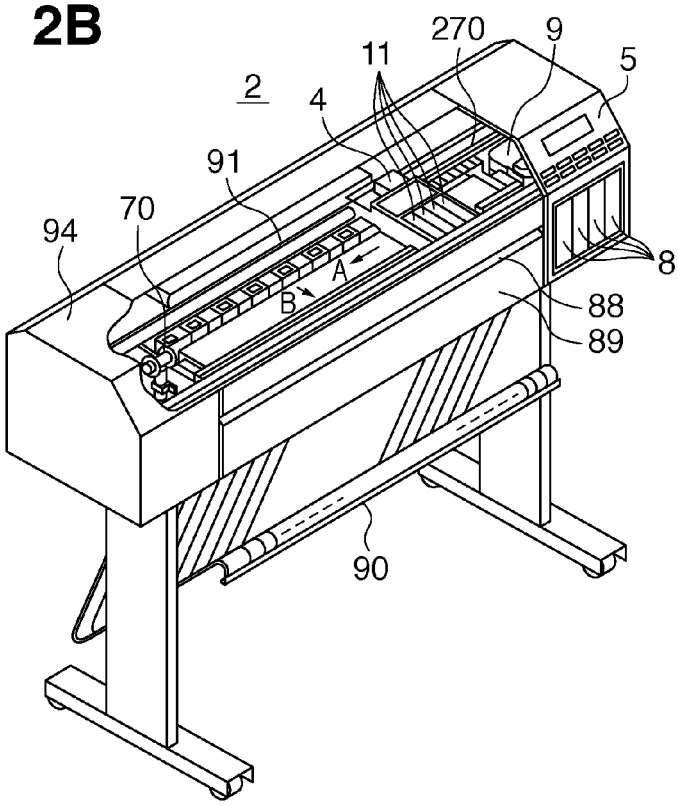

FIGS. 2A and 2B are perspective views showing the outer appearance of a printing apparatus using A0- and B0-size printing media. FIG. 2B is a perspective view showing a state in which the upper cover of the printing apparatus shown in FIG. 2A is removed.

As shown in FIG. 2A, a printing apparatus 2 has a manual insertion port 88 on the front surface, and a roll paper cassette 89 which can open to the front side is arranged below the manual insertion port 88. A printing medium such as printing paper is supplied from the manual insertion port 88 or roll paper cassette 89 into the printing apparatus. The printing apparatus 2 includes an apparatus main body 94 supported by two legs 93, a stacker 90 which receives a delivered printing medium, and an openable/closable see-through upper cover 91. An operation panel 12, ink supply units, and ink tanks are arranged on the right side of the apparatus main body 94.

As shown in FIG. 2B, the printing apparatus 2 further includes a conveyance roller 70 for conveying a printing medium in a direction (sub-scanning direction) indicated by an arrow B, and a carriage 4 which is guided and supported to be able to reciprocate in directions (indicated by an arrow A: main scanning direction) of the printing medium width. The printing apparatus 2 also includes a carriage motor (not shown) for reciprocating the carriage 4 in directions indicated by the arrow A, a carriage belt (to be referred to as a belt) 270, and a printhead 11 mounted on the carriage 4. The printing apparatus 2 includes an ink suction recovery unit 9 which supports smooth ink supply and cancels an ink discharge failure caused by clogging of the orifice of the printhead 11 or the like.

In this printing apparatus, the carriage 4 supports the printhead 11 made up of four heads in correspondence with four color inks to print in color on a printing medium. More specifically, the printhead 11 includes a K (blacK) head for discharging K ink, a C (Cyan) head for discharging C ink, an M (Magenta) head for discharging M ink, and a Y (Yellow) head for discharging Y ink.

When printing on a printing medium by this arrangement, the conveyance roller 70 conveys a printing medium to a predetermined printing start position. Then, the carriage 4 scans the printhead 11 in the main scanning direction, and the conveyance roller 70 conveys the printing medium in the sub-scanning direction. By repeating these operations, the printing apparatus prints on the entire printing medium.

More specifically, the belt 270 and carriage motor (not shown) move the carriage 4 in the directions indicated by the arrow A shown in FIG. 2B, printing on a printing medium. The carriage 4 then returns to a position (home position) before scanning, and the conveyance roller conveys the printing medium in the sub-scanning direction (direction indicated by the arrow B shown in FIG. 2B). After that, the carriage scans again in the directions indicated by the arrow A in FIG. 2B, thereby printing an image, character, or the like on the printing medium. After this operation is repeated to end printing of one printing medium, the printing medium is delivered into the stacker 90, completing printing of one printing medium.

<Description of Control Arrangement>

Next, a control arrangement for executing printing control of the printing apparatus described with reference to FIG. 1 or FIGS. 2A and 2B will be explained.

Figure 3:
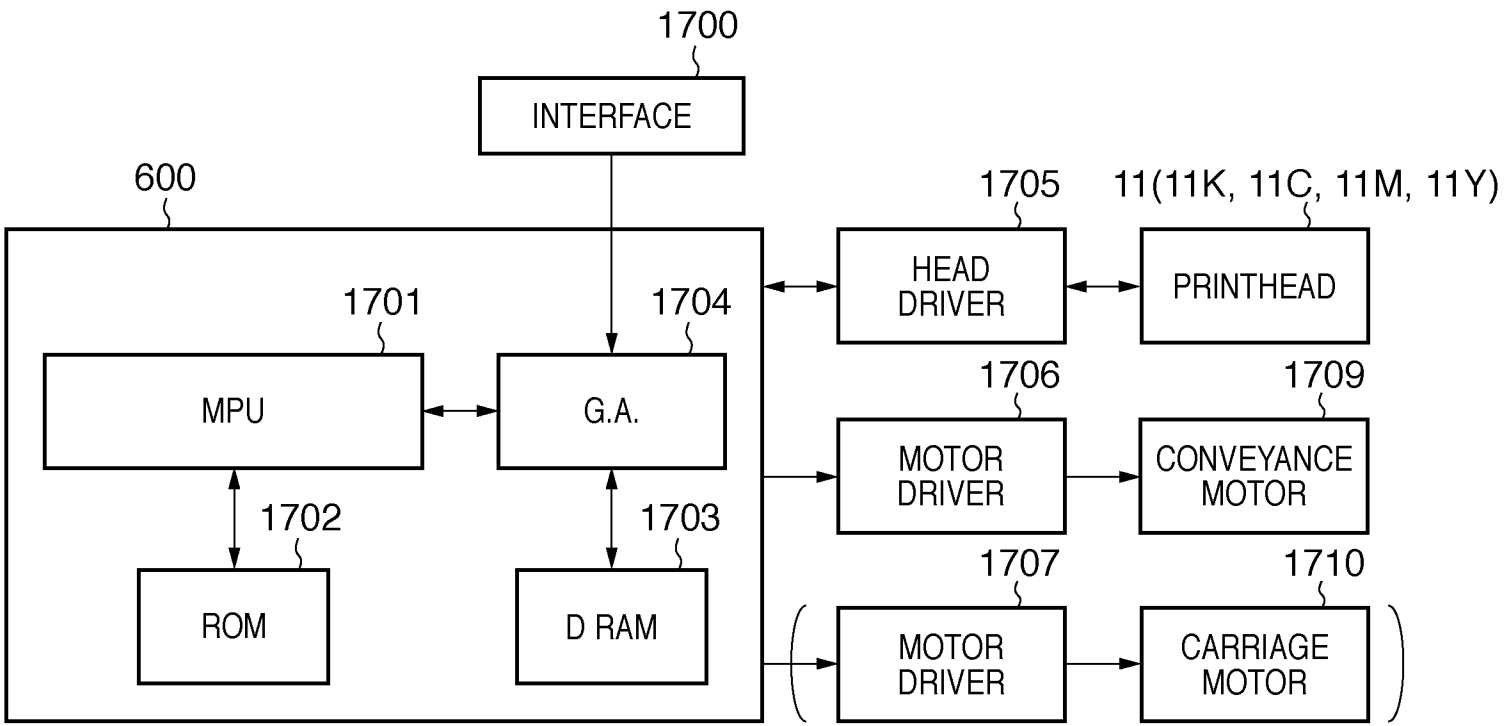
FIG. 3 is a block diagram showing the control arrangement of the printing apparatus shown in FIG. 1 or FIG. 2A or 2B.

FIG. 3 is a block diagram showing the arrangement of the control circuit of the printing apparatus. In FIG. 3, an interface 1700 inputs print data. A ROM 1702 stores a control program to be executed by an MPU 1701. A DRAM 1703 saves data such as print data, and a print signal to be supplied to the printhead. A gate array (G.A.) 1704 controls supply of a print signal to the printhead. The gate array 1704 also controls data transfer between the interface 1700, the MPU 1701, and the RAM 1703. A controller 600 includes the MPU 1701, ROM 1702, RAM 1703, and gate array 1704. A carriage motor 1710 conveys the printheads 11, that is, 11K, 11C, 11M, and 11Y. A conveyance motor 1709 conveys a printing sheet. A head driver 1705 drives the printhead, a motor driver 1706 drives the conveyance motor 1709, and a motor driver 1707 drives the carriage motor 1710.

For a printing apparatus using the full-line printhead as shown in FIG. 1, the carriage motor 1710 and the motor driver 1707 for driving the motor are not arranged, so their reference numerals are parenthesized in FIG. 3.

The operation of this control arrangement will be explained. When print data is input to the interface 1700, it is converted into a print signal for printing between the gate array 1704 and the MPU 1701. Then, the motor drivers 1706 and 1707 are driven. At the same time, the printhead is driven in accordance with the print data sent to the head driver 1705, thereby printing. Information on a transfer error (to be described later) obtained by the printhead is fed back to the MPU 1701 via the head driver 1705 and reflected in printing control.

Several embodiments of the printhead mounted in the printing apparatus having the foregoing arrangement will be described.

First Embodiment

Figure 4:
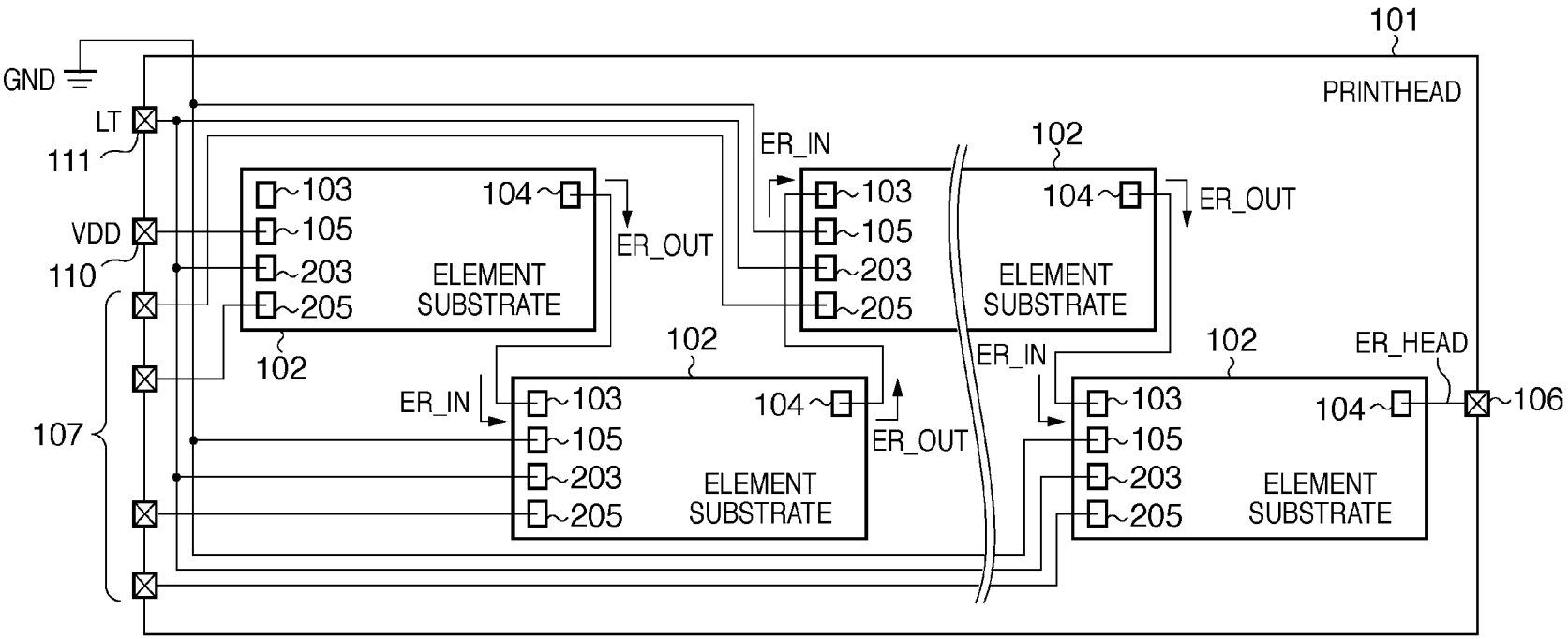
FIG. 4 is a block diagram showing the circuit arrangement of a printhead 101 according to the first embodiment.

FIG. 4 is a block diagram showing the circuit arrangement of a printhead 101 according to the first embodiment.

To achieve a large printing width, the printing width of the whole printhead 101 is increased by cascade-connecting a plurality (N) of element substrates 102. The element substrates 102 employ the same arrangement, and each of them has a terminal 103 for receiving information ER_IN of an element substrate on the preceding stage, and a terminal 104 for outputting information ER_OUT to an element substrate on the next stage. A terminal 105 of an element substrate on the first stage (leftmost stage in FIG. 4) among the cascade-connected element substrates is connected to an input pad 110 for inputting power VDD supplied from outside the printhead. The terminals 105 of the remaining element substrates are grounded. In correspondence with the number of element substrates, the printhead 101 has terminals 107 for inputting a print data signal DATA. In the first embodiment, the printhead 101 includes four element substrates 102, and thus has four terminals 107. The terminal 107 is connected to a terminal 205 of each element substrate for inputting the print data signal DATA. A controller 600 in the printing apparatus transfers the print data signal DATA for each element substrate.

The terminal 104 of an element substrate on the final stage (rightmost stage in FIG. 4) outputs a signal ER_HEAD to an output pad 106 of the printhead as a result of integrating pieces of information of all the element substrates. Note that an input pad 111 for inputting a latch signal LT to the printhead is commonly connected to latch input terminals 203 of all the element substrates.

Figure 5:
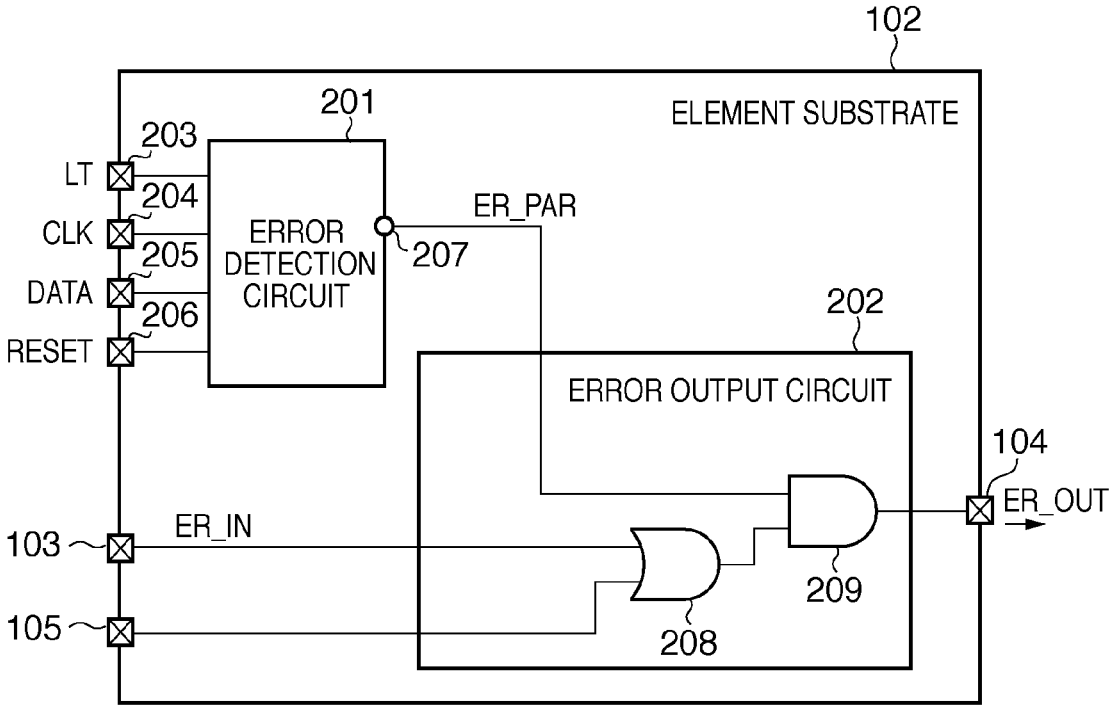
FIG. 5 is a block diagram showing the circuit arrangement of an element substrate 102.

FIG. 5 is a block diagram showing the circuit arrangement of the element substrate 102. On the element substrate, a plurality of printing elements (heaters), and a plurality of driving circuits corresponding to them are integrated. Further, a logic circuit formed from a shift register, latch, and decoder for supplying a driving signal to a plurality of driving circuits is integrated. However, these arrangements are well known and not illustrated for descriptive convenience, and only the characteristic building components of the present invention are illustrated. The print data signal DATA and a clock signal CLK are supplied via dedicated input pads (not shown) of the printhead 101, and serially transferred via a signal line (not shown) which serially connects all the element substrates. Accordingly, the print data signal is supplied to the shift registers arranged on all the element substrates.

The element substrate 102 includes an error detection circuit 201 which receives, via terminals 204 and 205, the clock signal CLK and print data signal DATA transferred from the printing apparatus main body and determines whether or not a transfer error occurs. The element substrate 102 further includes an error output circuit 202 which executes calculation based on determination information ER_PAR output from a terminal 207 of the error detection circuit 201 and information ER_IN input via the terminal 103 from an element substrate on the preceding stage. In FIG. 5, as described above, the terminal 105 of an element substrate on the first stage is connected to the power supply input pad 110, and those of element substrates on the remaining stages are grounded (GND connection). The error detection circuit 201 receives the latch signal LT via the latch input terminal 203, and a reset signal RESET via a reset input terminal 206.

Note that this embodiment employs a parity check circuit as the error detection circuit 201. The error detection circuit 201 updates information at the input timing of the latch signal LT or reset signal RESET, and outputs the error detection result ER_PAR to the outside (error output circuit in this example) via the terminal 207.

A parity bit is added to the print data signal DATA corresponding to the printing elements of one element substrate (to be referred to as "for one element substrate"). The data bit value is "1" when the signal level of each data bit is "High", and "0" when it is "Low". Each print data signal DATA for one element substrate contains the parity bit, and the parity bit value is determined so that the number of "1" bits becomes odd. The error detection circuit 201 checks, including the parity bit, the number of "1" bits of the print data signal for one element substrate that has been received from the printing apparatus main body or transferred from an element substrate on the preceding stage. If the number of "1" bits is even, the error detection circuit 201 determines that the print data signal has a transfer data error; if the number of "1" bits is odd, determines that the print data signal is free from a transfer data error.

The terminal 207 of the error detection circuit outputs an error detection result ER_PAR of signal level "High" indicating that no transfer error has occurred, or an error detection result ER_PAR of signal level "Low" indicating that a transfer error has occurred. The output timing is a timing when the latch signal LT is input to the latch input terminal 203.

Figure 6:
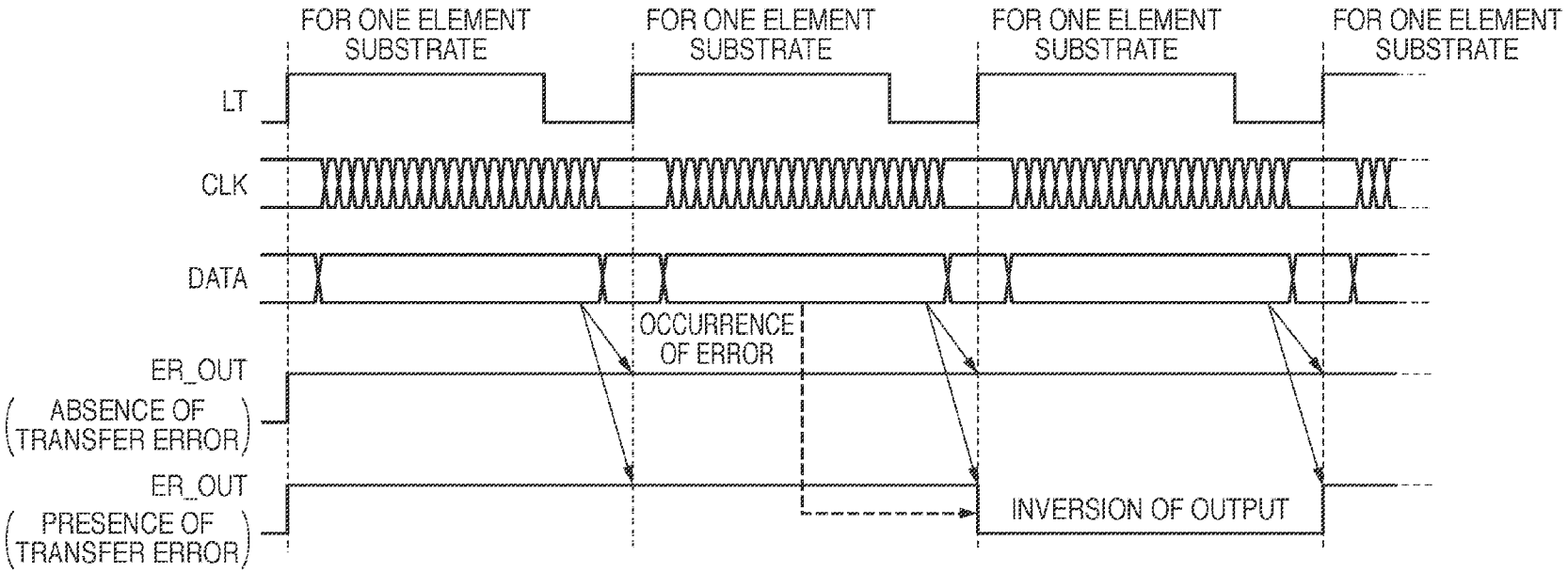
FIG. 6 is a timing chart of signals used in a circuit according to the first embodiment.

FIG. 6 is a timing chart of signals used in the circuit according to the first embodiment. Referring to FIG. 6, the print data signal for one element substrate is defined as one transfer cycle to transfer signals. In FIG. 6, the controller 600 transfers print data signals to the four element substrates shown in FIG. 4 in one transfer cycle. If no transfer error has occurred in the print data signal DATA transferred to the leftmost element substrate in FIG. 4, the error detection circuit 201 of the element substrate outputs an error detection result ER_PAR of signal level "High" in synchronism with the latch signal LT in the next transfer cycle.

Referring back to FIG. 5, the terminal 105 of the leftmost element substrate shown in FIG. 4 receives the power supply voltage VDD, and thus the signal level of this terminal becomes "High". Since the terminal 103 is not connected anywhere, its signal level becomes unstable. In the arrangement of the error output circuit 202 shown in FIG. 5, when the signal level of the terminal 105 is "High" and that of the terminal 103 is unstable, an output from an OR circuit 208 becomes "High", which serves as one input of an AND circuit 209. The other input of the AND circuit 209 is the error detection result ER_PAR. Thus, when the signal level of the error detection result ER_PAR is "High", the terminal 104 of the element substrate outputs information ER_OUT of signal level "High", which serves as information ER_IN to the terminal 103 of the element substrate 102 on the next stage.

If even the element substrate on the next stage does not detect a transfer error, the signal level of the error detection result ER_PAR from the error detection circuit 201 becomes "High". Although the terminal 105 of the element substrate on the next stage is grounded, the signal level of the information ER_IN input to the terminal 103 from the element substrate on the preceding stage is "High", so the signal level of output information ER_OUT from the element substrate on the next stage also becomes "High". Similarly, if element substrates on respective stages do not detect a transfer error, the signal level of a result signal ER_HEAD output from the terminal 104 of an element substrate on the final stage (rightmost stage in FIG. 4) to the output pad 106 of the printhead 101 becomes "High". In this manner, the signal ER_HEAD is obtained as a result of integrating pieces of information of all the element substrates after a delay corresponding to processes by all the element substrates of the printhead from the timing of the latch signal LT in the second transfer cycle from the left in FIG. 6. The same operation is executed as long as no transfer error occurs in the next print data signal DATA for one element substrate.

Figure 13:
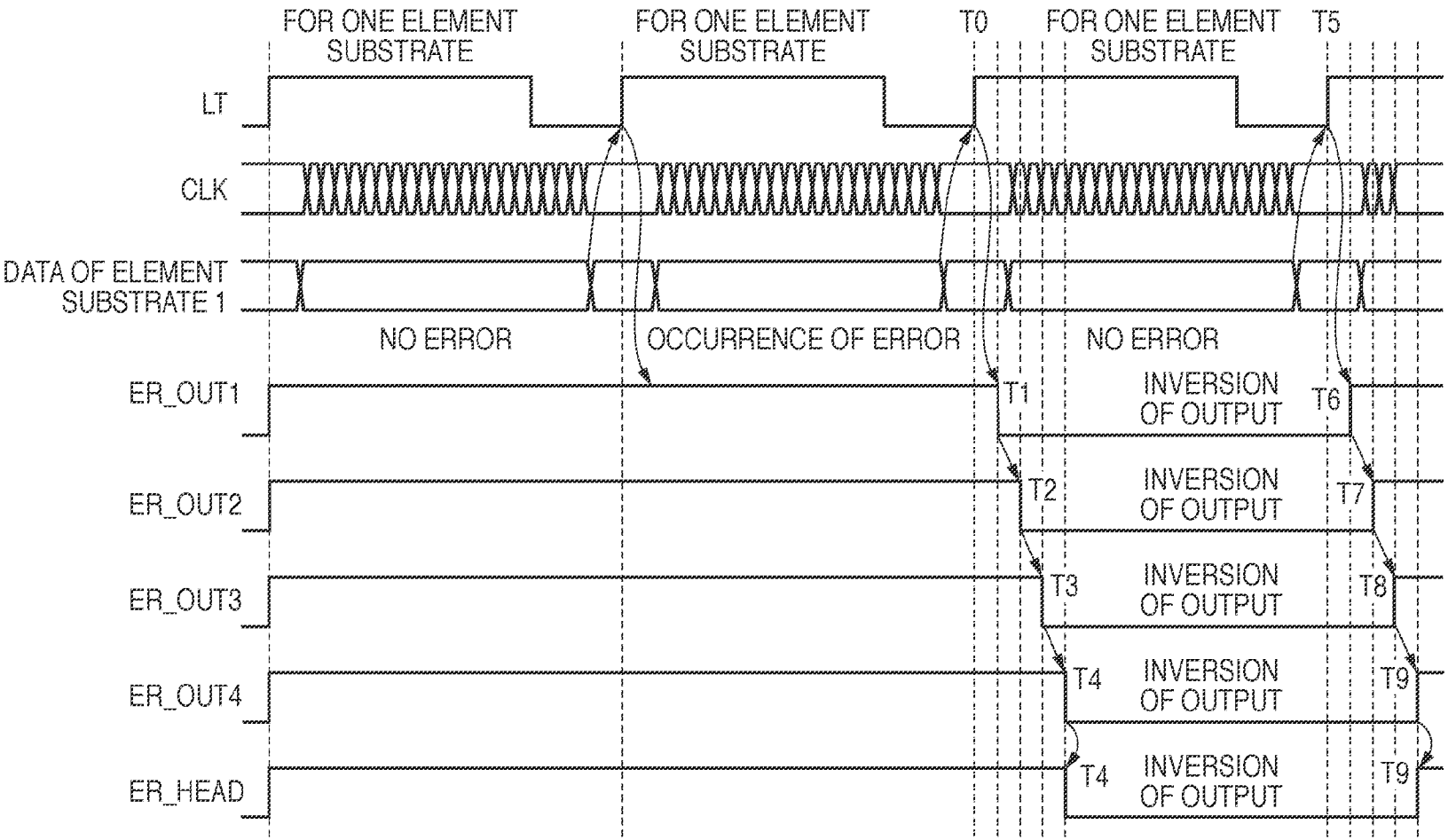
FIG. 13 is a timing chart of signals used in a circuit according to the first embodiment.

A case in which a transfer error has occurred in an element substrate on the nth stage in the printhead during transfer of the print data signal DATA will be considered. An arrangement in which the printhead 101 includes four element substrates will be exemplified. A case in which a transfer error has occurred in an element substrate on the first stage will be explained with reference to FIG. 13. The error is detected before timing TO, and the signal level of ER_OUT1 of the element substrate on the first stage becomes "Low" at timing T1 in response to this detection. This signal is input to an element substrate on the second stage. At timing T2, the signal level of ER_OUT2 of the element substrate on the second stage becomes "Low". Similarly, the signal level of ER_OUT3 of the element substrate on the third stage becomes "Low" at timing T3, and that of ER_OUT4 of the element substrate on the fourth stage becomes "Low" at timing T4. Hence, at timing T4, the output pad 106 outputs the signal level "Low" as the result signal ER_HEAD. Note that the time interval between timings T1 and T2, that between timings T2 and T3, and that between timings T3 and T4 correspond to times taken for signal processing in the error output circuit 202.

Figure 14:
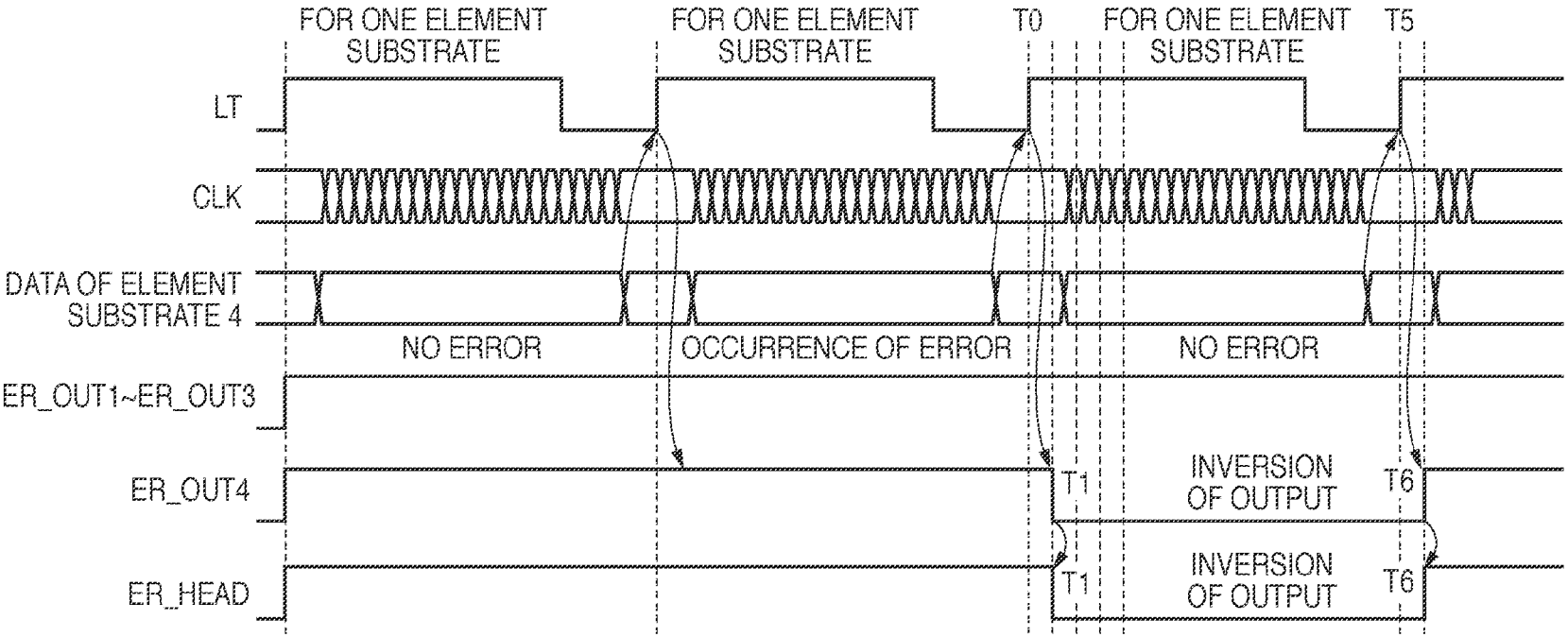
FIG. 14 is a timing chart of signals used in the circuit according to the first embodiment.

A case in which a transfer error has occurred in an element substrate on the fourth stage will be explained with reference to FIG. 14. In this case, the signal levels of ER_OUT1 to ER_OUT3 are "High", but that of ER_OUT4 of the element substrate on the fourth stage becomes "Low" at timing T1. At timing T1, the output pad 106 outputs the signal level "Low" as the result signal ER_HEAD.

As described above, a transfer error in an element substrate at an upstream side is sequentially transmitted and output to element substrates at a downstream side in the error transfer order. To specify an element substrate having an error when a transfer error occurs in an element substrate, the output results of the signals ER_OUT of the respective element substrates may be combined to output the signal of the combined information from a dedicated terminal.

According to the first embodiment described above, when one of N element substrates which form the printhead detects a transfer error, the printhead can notify the occurrence of the transfer error using a 1-bit information output. In the first embodiment, only the error output circuits 202 are cascade-connected. Therefore, even if the number of element substrates increases, a delay corresponding to the operation of the error detection circuit 201 does not increase. For this reason, a delay from input of the latch signal LT to output of the result signal ER_HEAD from the output pad 106 can be further shortened. In the first embodiment, the print data signal transfer error of the element substrate can be monitored in real time during the transfer while suppressing an increase in the number of signal lines.

The result signal ER_HEAD is fed back from the printhead 101 to the printing apparatus main body. If the received result signal ER_HEAD indicates that no transfer error has occurred, the printing apparatus main body keeps transferring the image data signal. To the contrary, if the result signal ER_HEAD indicates that a transfer error has occurred, the printing apparatus main body may transmit again a corresponding image data signal to control to reprint a portion where the transfer error has occurred. When the printhead is of the full-line type as shown in FIG. 1, the conveyance of a printing medium is desirably stopped to reprint. When the printing resolution and printing speed are high, it is also possible to control to keep printing, store information of a transfer error fed back from the printhead as an error history, and use it for future printing control.

This can improve the printing reliability of the printing apparatus.

Figure 7:
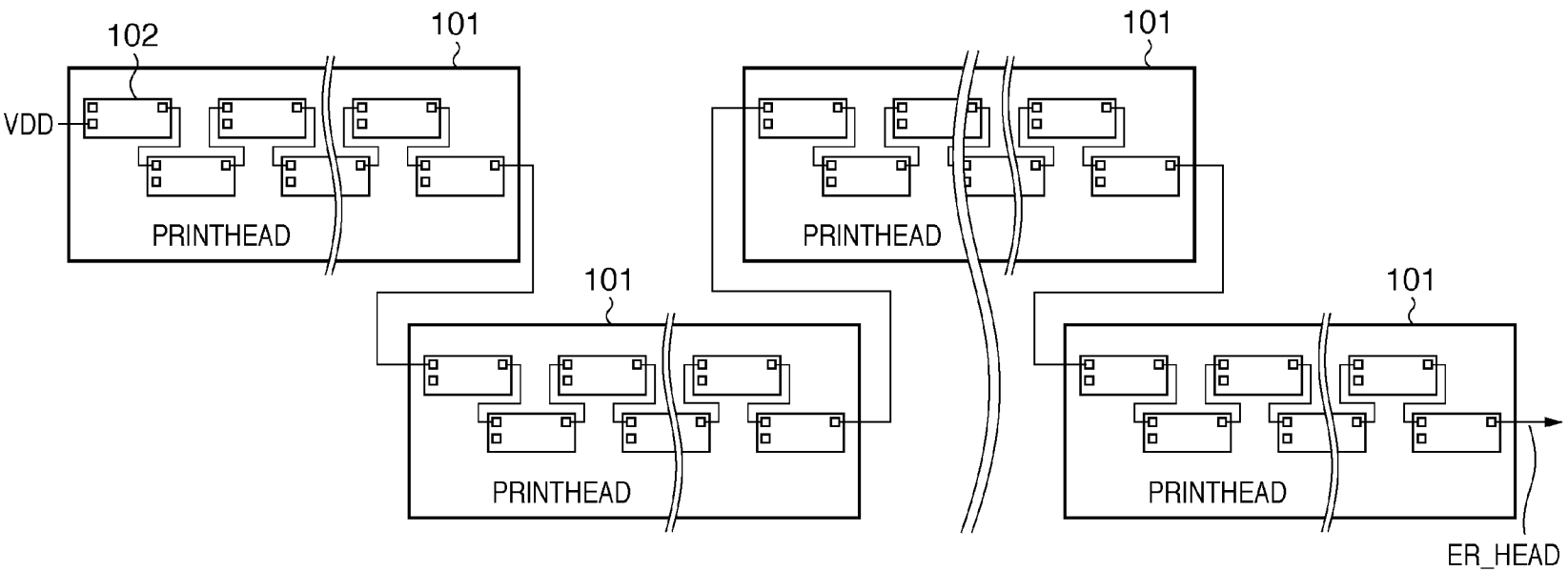
FIG. 7 is a view showing a state in which printheads 101 are cascade-connected.

FIG. 7 is a view showing a state in which the printheads 101 are cascade-connected. When the printing apparatus includes a plurality of printheads, pieces of information of all the printheads are cascade-connected. Also in this case, the print data signal transfer error of the entire printhead can be monitored in real time while suppressing an increase in the number of signal lines, similar to the case in which the element substrates are cascade-connected. In the arrangement in which the printheads are cascade-connected as shown in FIG. 7, the same effects can be obtained regardless of whether each printhead has one or a plurality of element substrates.

Figure 8:
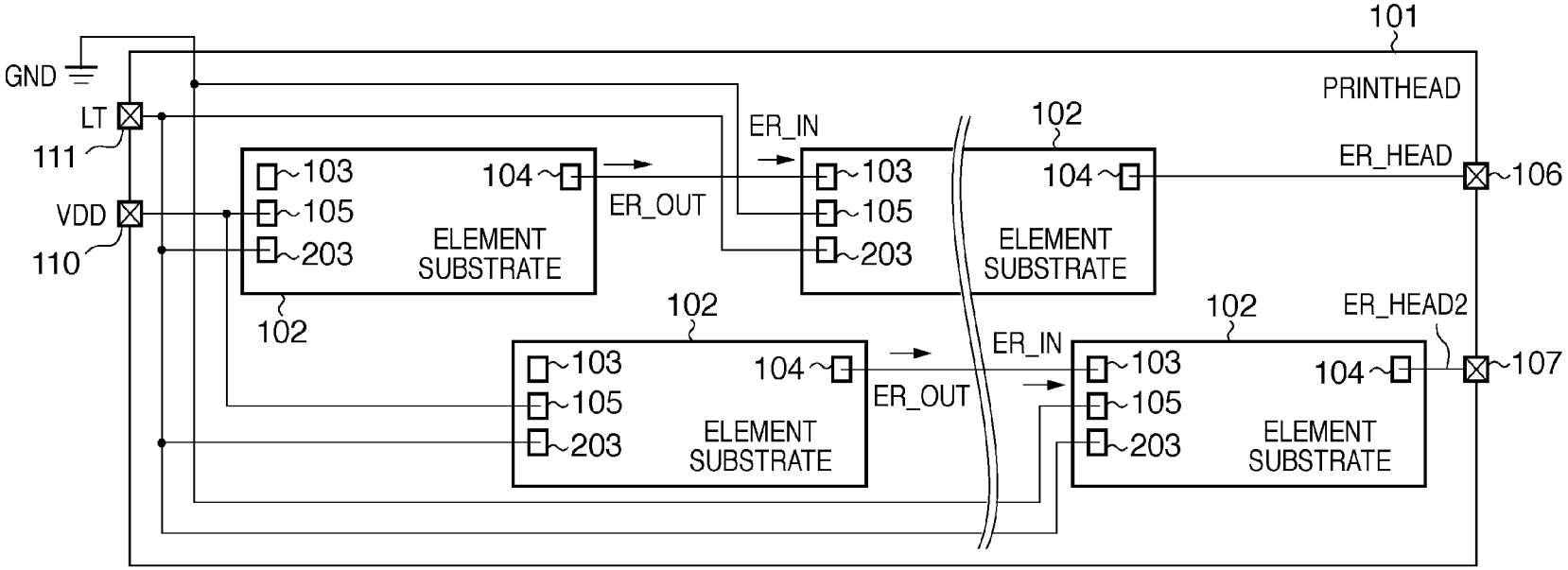
FIG. 8 is a block diagram showing a connection when the cascade-connection is divided into two groups.

The cascade-connection itself can be divided into a plurality of groups. FIG. 8 is a block diagram showing a connection when the cascade-connection is divided into two groups. FIG. 8 illustrates a case where these two groups respectively output the result signals ER_HEAD and ER_HEAD2. When the number of printheads or element substrates excessively increases or the circuit speed increases, the delay may not be ignored if the number of cascade-connections is only one. In this case, if the cascade-connection is divided into plural groups, although the number of terminals cannot be minimized, the delay can be reduced, and a transfer error can still be monitored in real time. Note that the same effects as those of the first embodiment can be obtained even by cascade-connection wiring other than the illustrated one.

Second Embodiment

Figure 9:
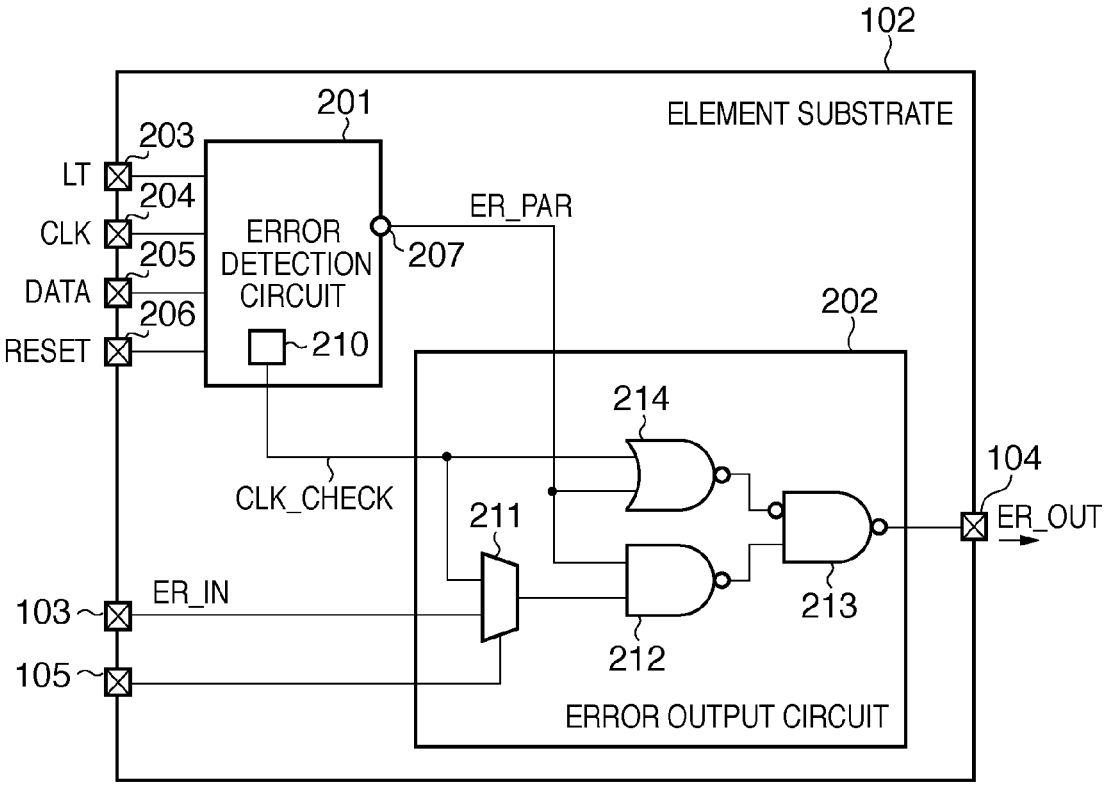
FIG. 9 is a block diagram showing the arrangement of an error output circuit 202 according to the second embodiment.

FIG. 9 is a block diagram showing the arrangement of an error output circuit 202 according to the second embodiment. In FIG. 9, the same reference numerals as those in the arrangement described in the first embodiment with reference to FIG. 5 denote the same parts, and a description thereof will not be repeated. In FIG. 9, the error output circuit 202 receives a clock check signal CLK CHECK for checking reception of the clock signal CLK and latch signal LT. A check signal output circuit 210 outputs the clock check signal CLK CHECK based on the logic level of check data CHK contained in a predetermined bit of the print data signal DATA. For example, if the logic level of the check data is "high", the check signal output circuit 210 outputs a high-level clock check signal CLK CHECK. If the logic level of the check data CHK is "low", the check signal output circuit 210 outputs a low-level clock check signal CLK CHECK. To perform this control, the gate array 1704 sets the logic level of the check data CHK in the print data signal DATA. A switch 211 in the error output circuit 202 selects the clock check signal CLK CHECK when the level of a signal input from a terminal 105 is "High", and selects information ER_IN input from a terminal 103 when it is "Low". Note that the signal input to the terminal 105 is identical to one described in the first embodiment.

Figure 10:
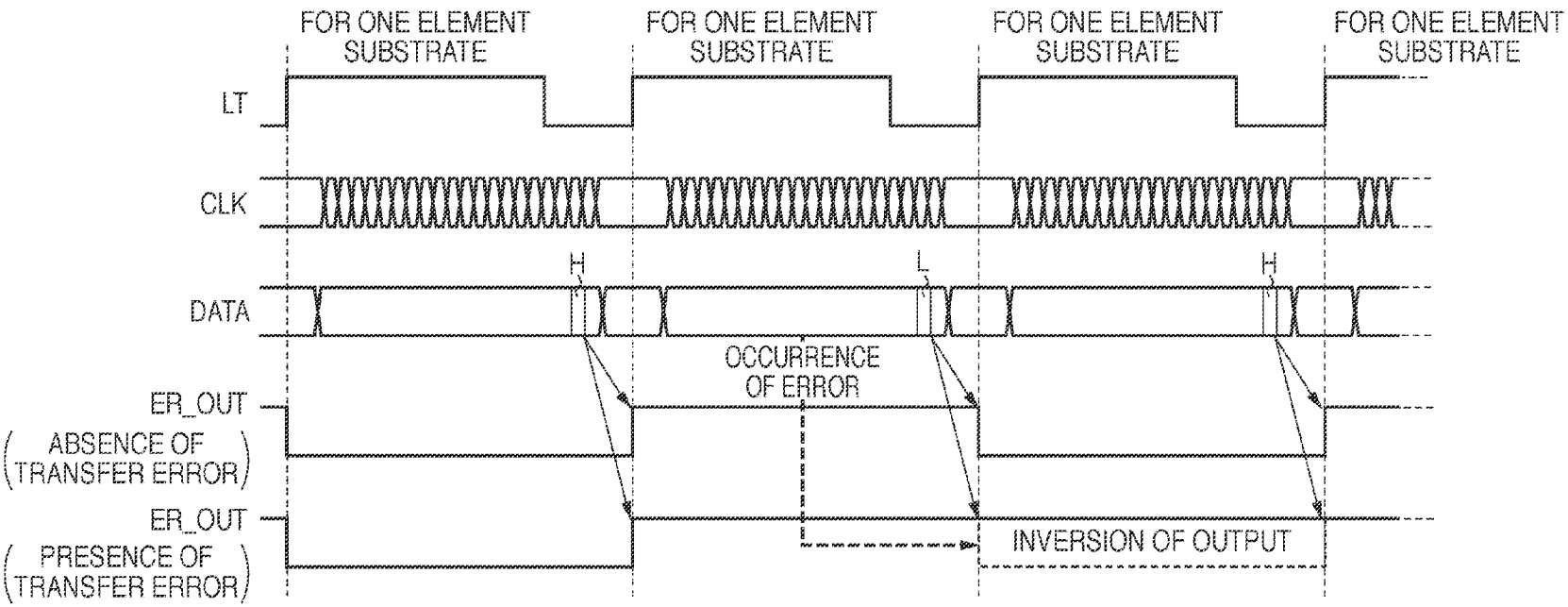
FIG. 10 is a timing chart of signals used in a circuit according to the second embodiment.

FIG. 10 is a timing chart of signals used in the circuit according to the second embodiment. The second embodiment also employs a printhead having the same arrangement as that described in the first embodiment with reference to FIG. 4. Referring to FIG. 10, the print data signal for one element substrate is defined as one transfer cycle to transfer signals.

A case in which the print data signal DATA for one element substrate is transferred to the leftmost element substrate in FIG. 4 will be considered. If the print data signal DATA does not have a transfer error, an error detection circuit 201 of the element substrate outputs an error detection result ER_PAR of signal level "High" in synchronism with the latch signal LT in the next transfer cycle.

The terminal 105 of an element substrate on the first stage (that is, the leftmost stage in FIG. 4) is connected to an input pad 110 of the printhead and receives the power supply voltage VDD. Thus, the signal level of the terminal 105 becomes "High", and the switch 211 selects the clock check signal CLK CHECK. In FIG. 10, the print data signal DATA for one element substrate contains the clock check signal CLK CHECK. If the signal level of the clock check signal CLK CHECK is "High" and that of the error detection result ER_PAR is "High", a terminal 104 of the element substrate on the first stage outputs information ER_OUT of signal level "High". The output is obtained in this manner, which will be apparent from the circuit arrangement of NAND circuits 212 and 213 and a NOR circuit 214 in the error output circuit 202 shown in FIG. 9. This information is input as information ER_IN to the terminal 103 of an element substrate on the next stage.

If the element substrate on the next stage does not detect a transfer error, the signal level of the error detection result ER_PAR from the error detection circuit 201 becomes "High". Since the terminal 105 of the element substrate on the next stage is grounded, the switch 211 selects the information ER_IN input from the terminal 103. Therefore, if the signal level of the information ER_IN input from the element substrate on the preceding stage is "High", that of output information ER_OUT from the element substrate on the next stage also becomes "High". Similarly, if element substrates on respective stages do not detect a transfer error, the signal level of a result signal ER_HEAD output from the terminal 104 of an element substrate on the final stage (rightmost stage in FIG. 4) to an output pad 106 of a printhead 101 becomes "High".

In this fashion, if all the element substrates do not detect a transfer error after a delay corresponding to processes by N element substrates, a signal ER_HEAD of signal level "High" is obtained for the first input print data signal for one element substrate.

Next, a case in which the next (second from the left in FIG. 10) print data signal DATA for one element substrate is transferred to an element substrate on the first stage will be considered. In this case, the signal level of the clock check signal CLK CHECK is inverted to "Low", as shown in FIG. 10.

If the transfer error of the print data signal DATA has not occurred in the element substrate on the first stage, the signal level of the error detection result ER_PAR from the error detection circuit 201 becomes "High". The switch 211 then selects the clock check signal CLK CHECK. In the logic circuit arrangement of the error output circuit in FIG. 9, information ER_OUT of signal level "Low" is output from the terminal 104 at the input timing of the latch signal LT of the third print data signal for one element substrate. If no transfer error occurs even in an element substrate on each subsequent stage, the output pad 106 of the printhead 101 outputs a result signal ER_HEAD of signal level "Low" after a delay corresponding to processes by N element substrates.

In the same manner, the signal level of the clock check signal CLK CHECK is inverted in every transfer of the print data signal DATA for one element substrate. As a consequence, the output pad 106 outputs a result signal ER_HEAD whose signal level is inverted in every transfer cycle.

A case in which a transfer error has occurred in an element substrate on the nth stage in the printhead during transfer of the next (second from the left in FIG. 10) print data signal DATA for one element substrate will be considered. Assuming that the transfer error of the print data signal DATA has not occurred up to an element substrate on the preceding, that is, (n−1)th stage, the terminal 103 of the element substrate on the nth stage receives information ER_IN of signal level "Low". The terminal 207 of the error detection circuit 201 on the nth stage outputs an error detection result ER_PAR of signal level "Low". Hence, the terminal 104 of the element substrate 102 on the nth stage outputs output information ER_OUT of signal level "High", as shown in FIG. 10.

The terminal 103 of an element substrate on the next, that is, (n+1)th stage receives information ER_IN of signal level "High". Thus, the terminal 104 of the element substrate 102 on the (n+1)th stage outputs information ER_OUT of signal level "High" regardless of whether a transfer error has occurred in the element substrate itself on the (n+1)th stage. Similarly, the output pad 106 of the printhead 101 outputs a result signal ER_HEAD of signal level "High".

According to the second embodiment described above, in addition to the effects described in the first embodiment, an abnormality arising from a reception failure of the clock signal or latch signal, or an output abnormality from the error output circuit can be detected because the signal level of the clock check signal is inverted every time a print data signal for one element substrate is transferred. Further, when the error detection circuit uses even parity check, it may be erroneously detected that no transfer error has occurred upon reception failure of a print data signal. However, even this detection error can be detected.

Third Embodiment

Figure 11:
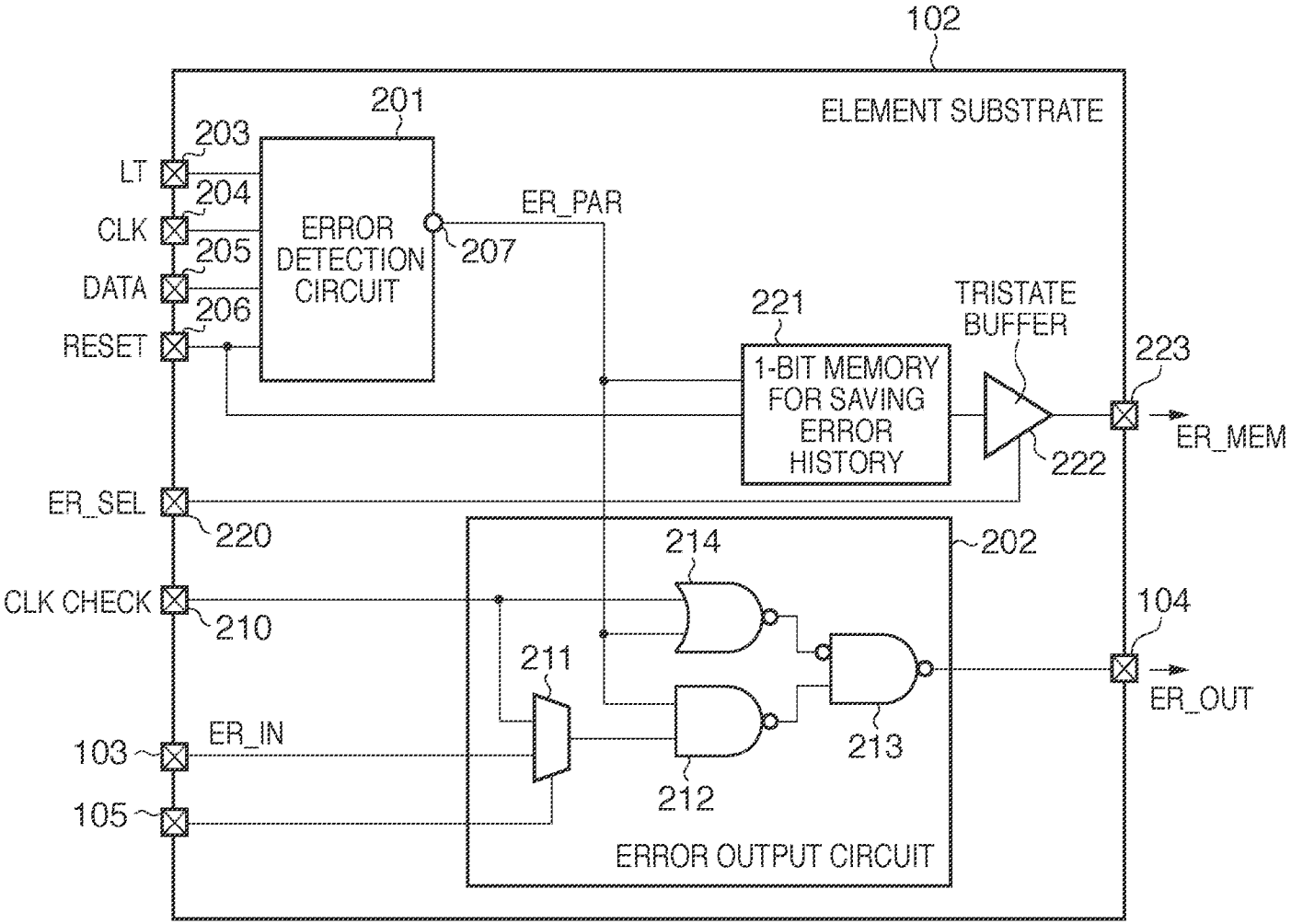
FIG. 11 is a block diagram showing the arrangement of an element substrate according to the third embodiment.

FIG. 11 is a block diagram showing the arrangement of an element substrate according to the third embodiment. In FIG. 11, the same reference numerals as those described in the first and second embodiments denote the same parts, and a description thereof will not be repeated. As is apparent from FIG. 11, the third embodiment has a feature in which the element substrate includes an error history save 1-bit memory (to be referred to as a memory) 221 for saving an error detection result ER_PAR output from the error detection circuit 201. The memory 221 outputs a memory content ER_MEM to the outside via a tristate buffer 222 and terminal 223. The tristate buffer 222 receives, via a terminal 220, a signal ER_SEL which is supplied from the printing apparatus main body and designates output.

Figure 12:
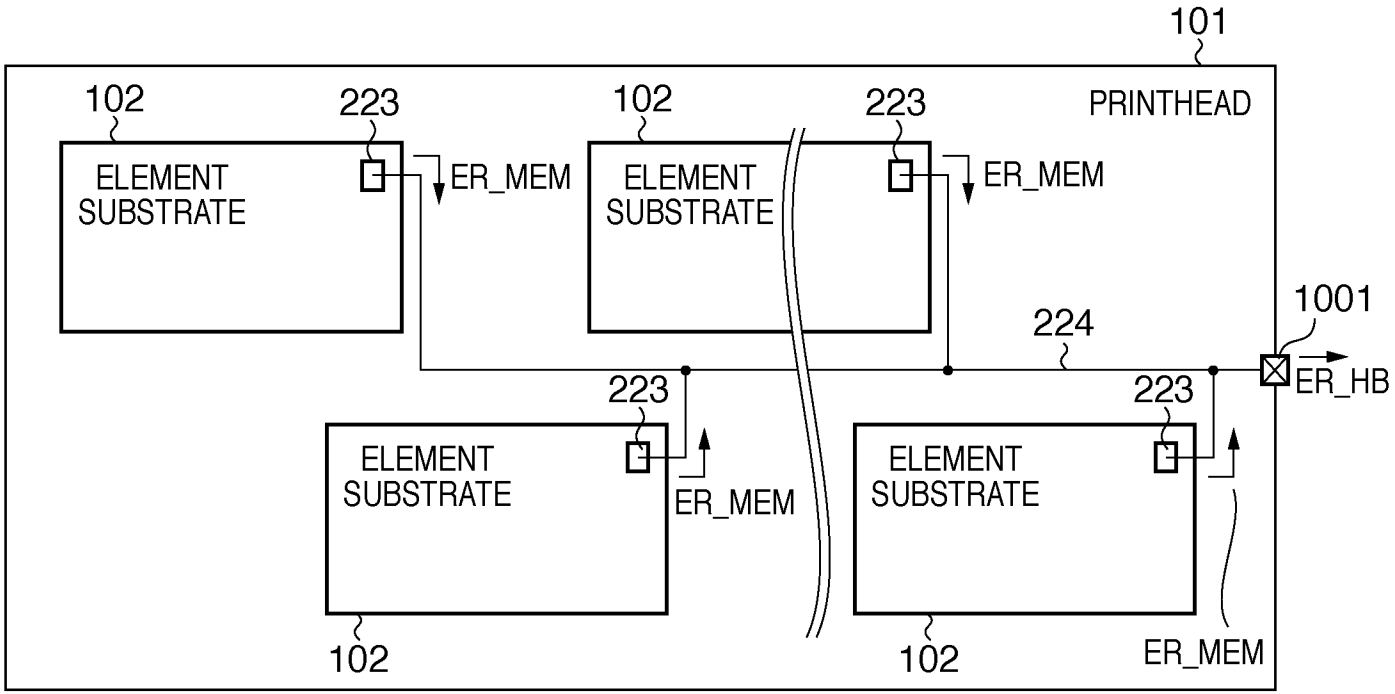
FIG. 12 is a block diagram showing an arrangement in which the content ER_MEM of a memory 221 is output to the outside of a printhead.

FIG. 12 is a block diagram showing an arrangement in which the content ER_MEM of the memory 221 is output outside the printhead. The printhead is constructed by connecting a plurality of element substrates. As shown in FIG. 12, the outputs of the memories of the respective element substrates are connected to a common wiring line 224. A signal ER_SEL which designates output from the memory is input to the terminal 220 of an element substrate whose error detection result is to be confirmed. To the contrary, a signal ER_SEL which designates suppression of output from the memory is input to the terminals 220 of the remaining element substrates. As a result, the error detection history of the specified element substrate is output as a signal ER_HB from a terminal 1001.

According to the third embodiment described above, an element substrate in which an error has occurred can be specified by monitoring the signal ER_HB though it cannot be specified using the signal ER_HEAD described in the first embodiment. With this arrangement, an occurred transfer error can be detected in real time in all element substrates, and the element substrate in which the error has occurred can be specified using a small number of wiring lines. Note that the size of data held in the memory 221 is not limited to 1 bit, and may be, for example, 16 bits or 32 bits if the integration space of the element substrate or the like is not limited.

Fourth Embodiment

Figure 15:
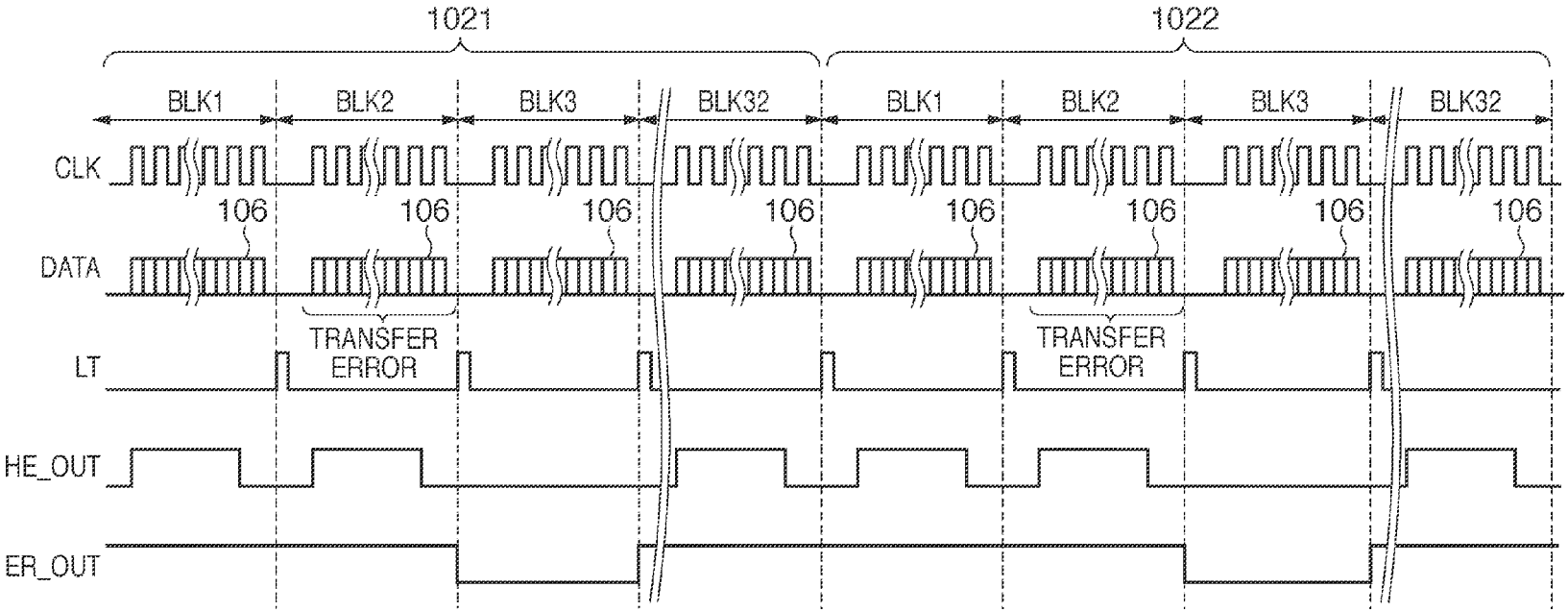
FIG. 15 is a timing chart of signals used in a circuit according to the fourth embodiment.

In the above-described embodiments, one printing cycle is defined as the print data signal transfer time during which one possible ink discharge opportunity is given to all the printing elements of the printhead. However, one printing cycle may be the transfer time of the print data signal DATA for one block in time-divisional drive. FIG. 15 is a signal transfer timing chart according to the fourth embodiment. FIG. 15 shows transfer of signals for time-divisionally driving all the printing elements of the printhead. The circuit arrangement is the same as those in the above-described embodiments except that the driving circuit on the element substrate drives printing elements divisionally in 32 blocks. For this purpose, DATA contains identification information of a block. The element substrate further includes a determination circuit for determining the identification information.

As shown in FIG. 15, print data 1021 of one column for BLK1 to BLK32 is transferred divisionally for each block. For example, in the period BLK1, data used to print by printing elements belonging to the first block, and identification information are transferred. Similarly, in the period BLK32, data used to print by printing elements belonging to the 32th block, and identification information are transferred. Print data 1022 is data of a column next to the print data 1021. BLK1 or BLK32 indicates even the printing cycle of one block.

FIG. 15 shows a state in which a transfer error occurs in the period BLK2 of the print data 1021 and an ER_OUT signal is output in the period BLK3. Also, this figure indicates that in the period BLK2 of the print data 1022, a transfer error similarly occurs.

As described above, the printhead, which performs time-divisional drive, can output an error detection result for each block.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-108676, filed May 10, 2010, which is hereby incorporated by reference herein in its entirety.

What is claimed is:

1. A printhead comprising a plurality of element substrates, each having a plurality of printing elements and a driving circuit for driving the plurality of printing elements, each of the plurality of element substrates comprising:

an error detection circuit, connected to a first terminal for inputting print data from outside and to a second terminal for inputting a clock signal from outside, configured to detect whether or not a transfer error has occurred in a print data signal corresponding to printing elements of one element substrate input to the first terminal; and an error output circuit configured to receive a detection result from the error detection circuit, and output the result of detection to outside, wherein a plurality of error output circuits included in the plurality of element substrates are cascade-connected via a third terminal different from the first and second terminals, and wherein the error output circuit on an n-th stage, other than the error output circuits on a first stage and a final stage of the plurality of cascade-connected error output circuits, is further configured to output information, based on a detection result received from the error output circuit on an (n−1)-th stage and a detection result from the error detection circuit on the n-th stage, to the error output circuit on an (n+1)-th stage.

2. The printhead according to claim 1, wherein a parity bit is added in every transfer of the print data signal corresponding to the printing elements of one element substrate, and the error detection circuit of the one element substrate comprises a parity check circuit.

3. The printhead according to claim 1, wherein a plurality of the printheads are further cascade-connected.

4. The printhead according to claim 1, wherein the plurality of element substrates are divided into a plurality of groups, and the element substrates are cascade-connected in each group.

5. The printhead according to claim 1, wherein each of the plurality of element substrates further comprises:

a memory which stores a result of detection by the error detection circuit of the element substrate; and a terminal which inputs a signal designating output of the detection result stored in the memory, the printhead further comprises:

a common wiring line which connects outputs from the memories of the plurality of element substrates; and a terminal which outputs a signal from the common wiring line to the outside, and the memory of an element substrate designated by the signal designating output outputs the detection result.

6. The printhead according to claim 1, wherein the printhead is an inkjet printhead.

7. A printing apparatus that prints using a printhead according to claim 1, the apparatus comprising:

a reception unit configured to receive presence/absence of a transfer error from the printhead; and a control unit configured to control to continue transfer or retransmission of a print data signal in accordance with the presence/absence of the transfer error received by the reception unit.

8. The printhead according to claim 1, wherein the detection result is a logical signal indicating either a high level or low level, one of the high level and the low level indicates that no transfer error has occurred, and the other of the high level and the low level indicates that a transfer error has occurred.

9. The printhead according to claim 8, wherein, in the error output circuits on the first stage of the plurality of cascade-connected error output circuits, a signal level in the logical signal corresponding to the detection result indicating that no transfer error has occurred and the signal level in the logical signal corresponding to the detection result indicating that the transfer error has occurred are opposite.

10. The printhead according to claim 1, wherein the error detection circuit on each stage detects whether or not the transfer error has occurred in the print data signal every time the print data signal is transferred and latched.

11. The printhead according to claim 1, wherein in a case where the detection result received from the error output circuit on the (n−1)-th stage contains an error, the error output circuit on the n-th stage is further configured to output the detection result, which contains the error, to the error output circuit on the (n+1)-th stage regardless of the detection result from the error detection circuit on the n-th stage.

12. The printhead according to claim 1, wherein in a case where the detection result received from the error output circuit on the (n−1)-th stage does not contain any error, the error output circuit on the n-th stage is further configured to output the detection result from the error detection circuit on the n-th stage to the error output circuit on the (n+1)-th stage.

13. A printhead comprising a plurality of element substrates, each having a plurality of printing elements and a driving circuit for time-divisionally driving the plurality of printing elements for each block, each of the plurality of element substrates comprising:

an error detection circuit, connected to a first terminal for inputting print data from outside and to a second terminal for inputting a clock signal from outside, configured to detect whether or not a transfer error has occurred in a print data signal corresponding to printing elements of one block input to the first terminal; and an error output circuit configured to receive a detection result from the error detection circuit, and output the result of detection to outside, wherein a plurality of error output circuits included in the plurality of element substrates are cascade-connected via a third terminal different from the and second terminals, and wherein the error output circuit on an n-th stage, other than the error output circuits on a first stage and a final stage of the plurality of cascade-connected error output circuits, is further configured to output information, based on a detection result received from the error output circuit on an (n−1)-th stage and a detection result from the error detection circuit on the n-th stage, to the error output circuit on an (n+1)-th stage.

14. The printhead according to claim 13, wherein the printhead is an inkjet printhead.

15. A printing apparatus which prints using a printhead according to claim 13, the apparatus comprising:

a reception unit configured to receive presence/absence of a transfer error from the printhead; and a control unit which controls to continue transfer or retransmission of a print data signal in accordance with the presence/absence of the transfer error received by the reception unit.

16. The printhead according to claim 13, wherein the detection result is a logical signal indicating either a high level or low level, one of the high level and the low level indicates that no transfer error has occurred, and the other of the high level and the low level indicates that a transfer error has occurred.

17. The printhead according to claim 16, wherein, in the error output circuits on the first stage of the plurality of cascade-connected error output circuits, a signal level in the logical signal corresponding to the detection result indicating that no transfer error has occurred and the signal level in the logical signal corresponding to the detection result indicating that the transfer error has occurred are opposite.

18. The printhead according to claim 13, wherein the error detection circuit on each stage detects whether or not the transfer error has occurred in the print data signal every time the print data signal is transferred and latched.

* * * * *